United States Patent [19]

Hollje

[11] Patent Number: 5,054,661

[45] Date of Patent: Oct. 8, 1991

[54] PAINT BUCKET CONSTRUCTION

[76] Inventor: Anthony K. Hollje, 835 Woodlawn, Paris, Tex. 75460

[21] Appl. No.: 493,632

[22] Filed: Mar. 15, 1990

[51] Int. Cl.[5] ..... A47G 19/14

[52] U.S. Cl. ..... 222/465.1; 222/572; 15/257.05; 220/90; 220/570

[58] Field of Search ..... 222/465.1, 475, 566, 222/571, 572; 15/257.05; 220/90, 570; D32/53, 53.1

[56] References Cited

U.S. PATENT DOCUMENTS

| | | | |
|---|---|---|---|
| D. 28,095 | 12/1897 | Mills | D32/53 |
| D. 180,309 | 5/1957 | Willis | D32/53 |
| D. 245,450 | 8/1977 | Donion | D32/53.1 |
| D. 296,948 | 7/1988 | Fuller | D32/53 |
| 2,215,607 | 9/1940 | Eastwood | 222/566 |
| 2,827,648 | 3/1958 | Geisz | 220/90 |
| 3,245,565 | 4/1966 | Zeppenfeld et al. | 222/567 |
| 3,707,242 | 12/1972 | Golden et al. | 220/570 |
| 4,893,723 | 1/1990 | Seabolt | 220/90 |

*Primary Examiner*—Michael S. Huppert
*Assistant Examiner*—Shari Wunsch
*Attorney, Agent, or Firm*—Leon Gilden

[57] ABSTRACT

A paint bucket construction defining a cylindrical container including a support projection formed with an interior cavity directed orthogonally upwardly from an upper edge of the container, wherein the projection includes a handle axially offset relative to the container axis and a forward edge of the projection aligned in a common plane as the axis of the container. A pouring spout formed in the container is diametrically opposed to and aligned with the handle and extends outwardly of the upper edge of the container. Optionally, a matrix of individual projections are directed upwardly of an interior surface of the spout, wherein the projections include upper tips directed upwardly and forwardly towards an upper edge of the spout to assist in positioning of a paint brush and the like positioned within the spout. A threadedly removable lower cup member is mounted in the container for its enhanced ease of cleaning of the organization in use.

1 Claim, 5 Drawing Sheets

PRIOR ART

PAINT BUCKET CONSTRUCTION

BACKGROUND OF THE INVENTION

1. Field of the Invention

The field of invention relates to bucket constructions, and more particularly pertains to a new and improved paint bucket construction wherein the same provides a concave projection mounting a handle limiting spillage of paint within the bucket construction, as well as positioning a handle relative to a spout providing ease of use of the organization.

2. Description of the Prior Art

Buckets of various types and configurations have been provided in the prior art. Heretofore, however, in bucket construction, and those particularly associated in a painting procedure, a bucket has not been provided to provide ease of transport of paint within the associated bucket container, as well as providing spout and handle construction for ease of use of the bucket in association with painting implements, such as brushes and the like. Examples of the prior art include U.S. Pat. No. 2,215,607 to Eastwood setting forth a milk pail with a pivotally mounted lid and a handle of a generally typical configuration as utilized in buckets for support of fluids therewithin.

U.S. Pat. Nos. 296,948; 245,450; and 180,309 are further examples of prior art bucket constructions of typical cylindrical configurations arranged for support of fluids therewithin.

As such, it may be appreciated that there continues to be a need for a new and improved paint bucket construction wherein the same addresses both the problems of ease of use, as well as effectiveness in construction as particularly applied for use in a painting procedure for support of paint fluid within the bucket and in this respect, the present invention substantially fulfills this need.

SUMMARY OF THE INVENTION

In view of the foregoing disadvantages inherent in the known types of bucket constructions now present in the prior art, the present invention provides a paint bucket construction wherein the same is arranged to orient a handle overlying a container and arranged in generally parallel alignment to the axis of the container with a forwardly positioned spout of the container aligned with the handle construction for ease of manipulation and transport of paint within the bucket. As such, the general purpose of the present invention, which will be described subsequently in greater detail, is to provide a new and improved paint bucket construction which has all the advantages of the prior art bucket constructions and none of the disadvantages.

To attain this, the present invention provides a paint bucket construction defining a cylindrical container including a support projection formed with an interior cavity directed orthogonally upwardly from an upper edge of the container, wherein the projection includes a handle axially offset relative to the container axis and a forward edge of the projection aligned in a common plane as the axis of the container. A pouring spout formed in the container is diametrically opposed to and aligned with the handle and extends outwardly of the upper edge of the container. Optionally, a matrix of individual projections are directed upwardly of an interior surface of the spout, wherein the projections include upper tips directed upwardly and forwardly towards an upper edge of the spout to assist in positioning of a paint brush and the like positioned within the spout. A threadedly removable lower cup member is mounted in the container for its enhanced ease of cleansing of the organization.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved paint bucket construction which has all the advantages of the prior art bucket constructions and none of the disadvantages.

It is another object of the present invention to provide a new and improved paint bucket construction which may be easily and efficiently manufactured and marketed.

It is a further object of the present invention to provide a new and improved paint bucket construction which is of a durable and reliable construction.

An even further object of the present invention is to provide a new and improved paint bucket construction which is susceptible of a low cost of manufacture with regard to both materials and labor, and which accordingly is then susceptible of low prices of sale to the consuming public, thereby making such paint bucket constructions economically available to the buying public.

Still yet another object of the present invention is to provide a new and improved paint bucket construction which provides in the apparatuses and methods of the prior art some of the advantages thereof, while simultaneously overcoming some of the disadvantages normally associated therewith.

Still another object of the present invention is to provide a new and improved paint bucket construction wherein the same provides arrangement of the various components of a paint bucket to enhance ease of transport and manipulation of paint within the bucket construction while minimizing spillage of the paint fluid contained therewithin.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 10 is an orthographic partial sectional view of the bucket construction of FIGS. 7 and 8, including a removable container portion.

DESCRIPTION OF THE PREFERRED EMBODIMENT

Figure 1:
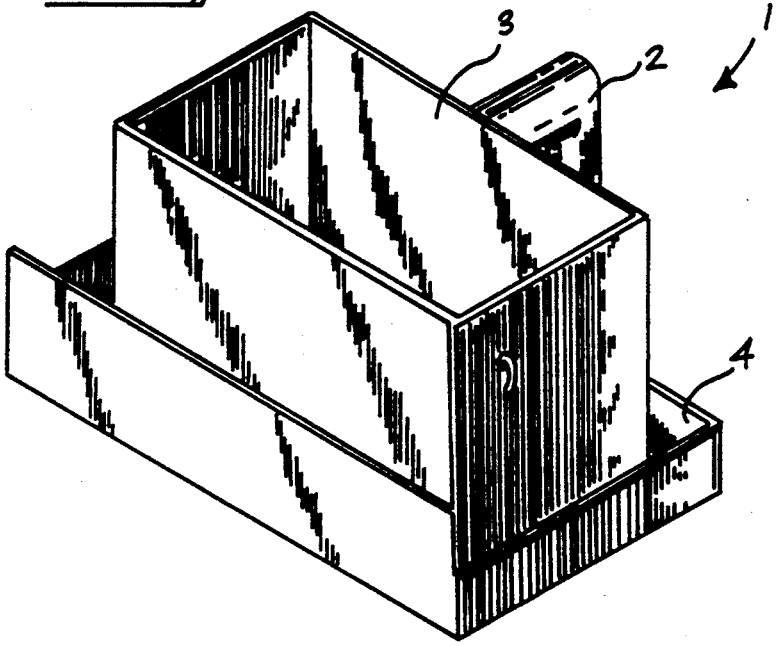
FIG. 1 is an isometric illustration of a prior art bucket construction.

With reference now to the drawings, and in particular to FIGS. 1 to 11 thereof, a new and improved paint bucket construction embodying the principles and concepts of the present invention and generally designated by the reference numerals 10, **10*a*, 10*b*, and 10*c*** will be described.

Figure 2:
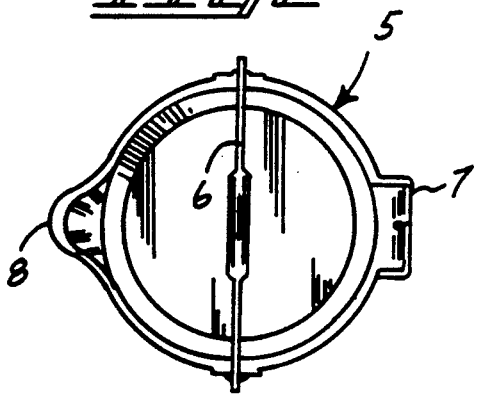
PRIOR ART FIG 2
FIG. 2 is a top orthographic view of a prior art bucket construction.
Figure 3:
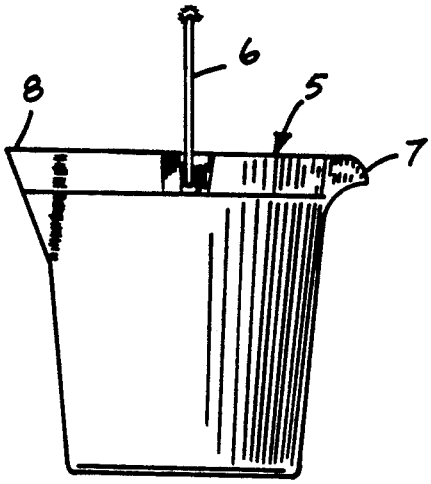
PRIOR ART FIG 3
FIG. 3 is an orthographic side view taken in elevation of the prior art bucket construction, as illustrated in FIG. 2.
Figure 4:
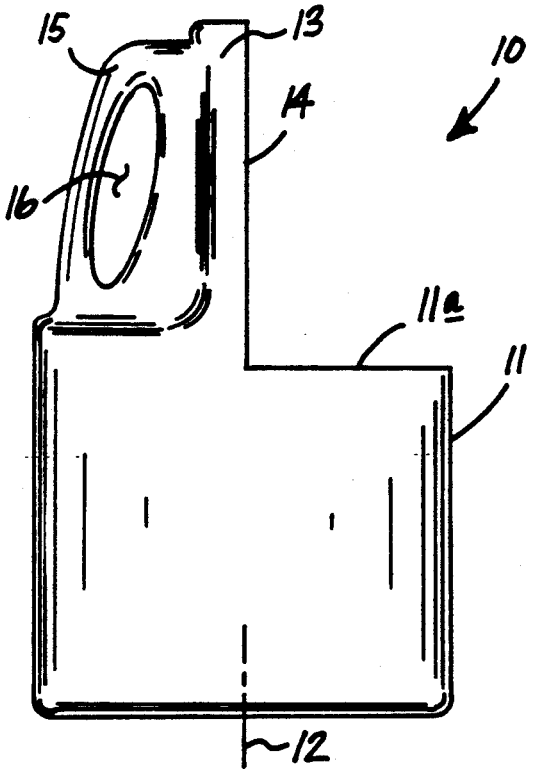
FIG. 4 is an orthographic side view taken in elevation of the instant invention.
Figure 5:
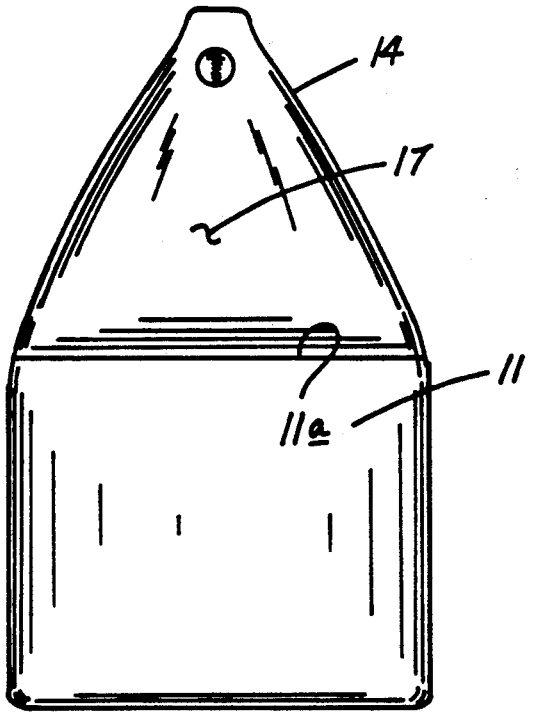
FIG. 5 is an orthographic frontal view taken in elevation of the instant invention.

FIG. 1 illustrates a prior art bucket construction 1 utilizing a handle 2 mounted adjacent a generally rectangular container 3, with a lower support overflow container 4 mounted in surrounding underlying relationship thereto. FIG. 2 illustrates a further prior art bucket 5, with a transport handle 6 mounted pivotally to an upper end of the central bucket container, with a spout 8 and a handle 7 arranged in aligned diametrically opposed relationship relative to the central container.

More specifically, the paint bucket container 10 of the instant invention essentially comprises a cylindrical container 11 defined by an upper semi-circular aligned edge **11*a* arranged in orthogonal relationship relative to the container axis 12. A support projection 13 projects orthogonally and upwardly relative to the edge 11*a*, and includes a vertical forward edge 14 defining a plane aligned with and including the axis 12 of the container 11. The vertical forward edge 14 accordingly is diametrically mounted and extends from opposed portions of the upper edge 11*a*, as illustrated. The projection 13 includes a handle 15 orthogonally oriented relative to the forward edge 14 and defines an enclosed elliptical opening 16 for reception of an individual's hand for transport of the bucket in use. The projection 13 defines a concave cavity 17 therewithin, wherein the paint and other fluids contained within the container 11 are protected from an individual's hand grasping the handle 15 and during transport, the container 11 may be tipped slightly rearwardly to accommodate fluid within the cavity 17** to minimize spillage thereof.

Figure 6:
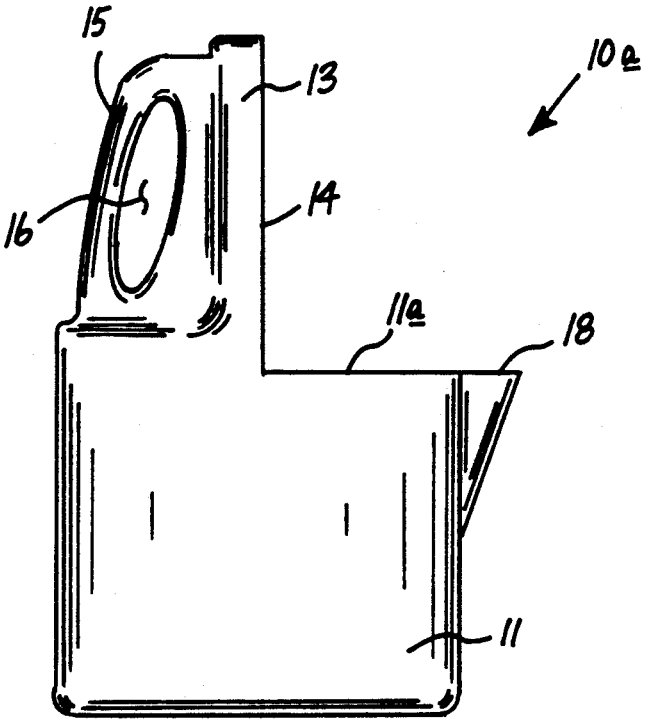
FIG. 6 is an orthographic side view taken in elevation of a modified bucket construction utilized by the instant invention.
Figure 7:
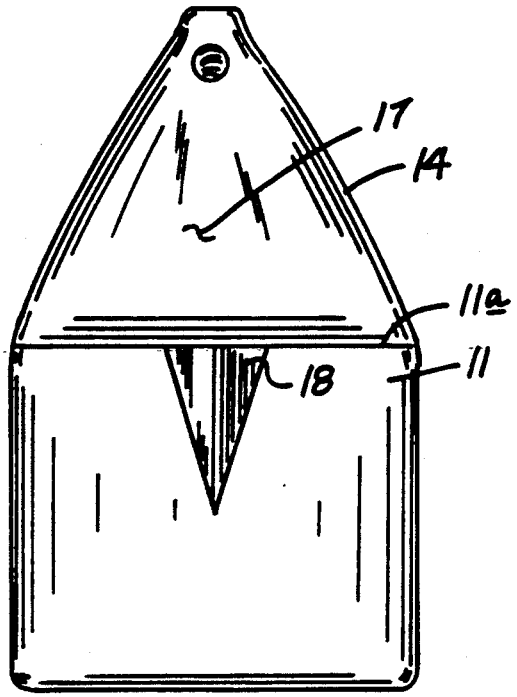
FIG. 7 is an orthographic front view taken in elevation of the bucket construction, as illustrated in FIG. 6.

FIGS. 6 and 7 illustrate the bucket construction **10*a*, including a pouring spout 18 parallel to and aligned with the handle 15 and mounted diametrically opposed to the handle 15 extending forwardly of the upper edge 11*a*. The spout 18 may be either of a conical or pyramidal construction extending forwardly of the container 11. Further, the upper edge of the spout 18 is aligned with the upper edge 11*a* of the container 11**.

Figure 8B:
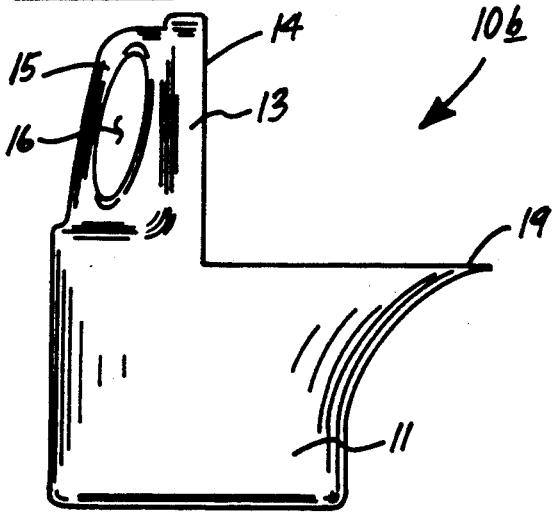
FIG. 8 is an orthographic side view taken in elevation of a further modified bucket construction of the instant invention.
Figure 9:
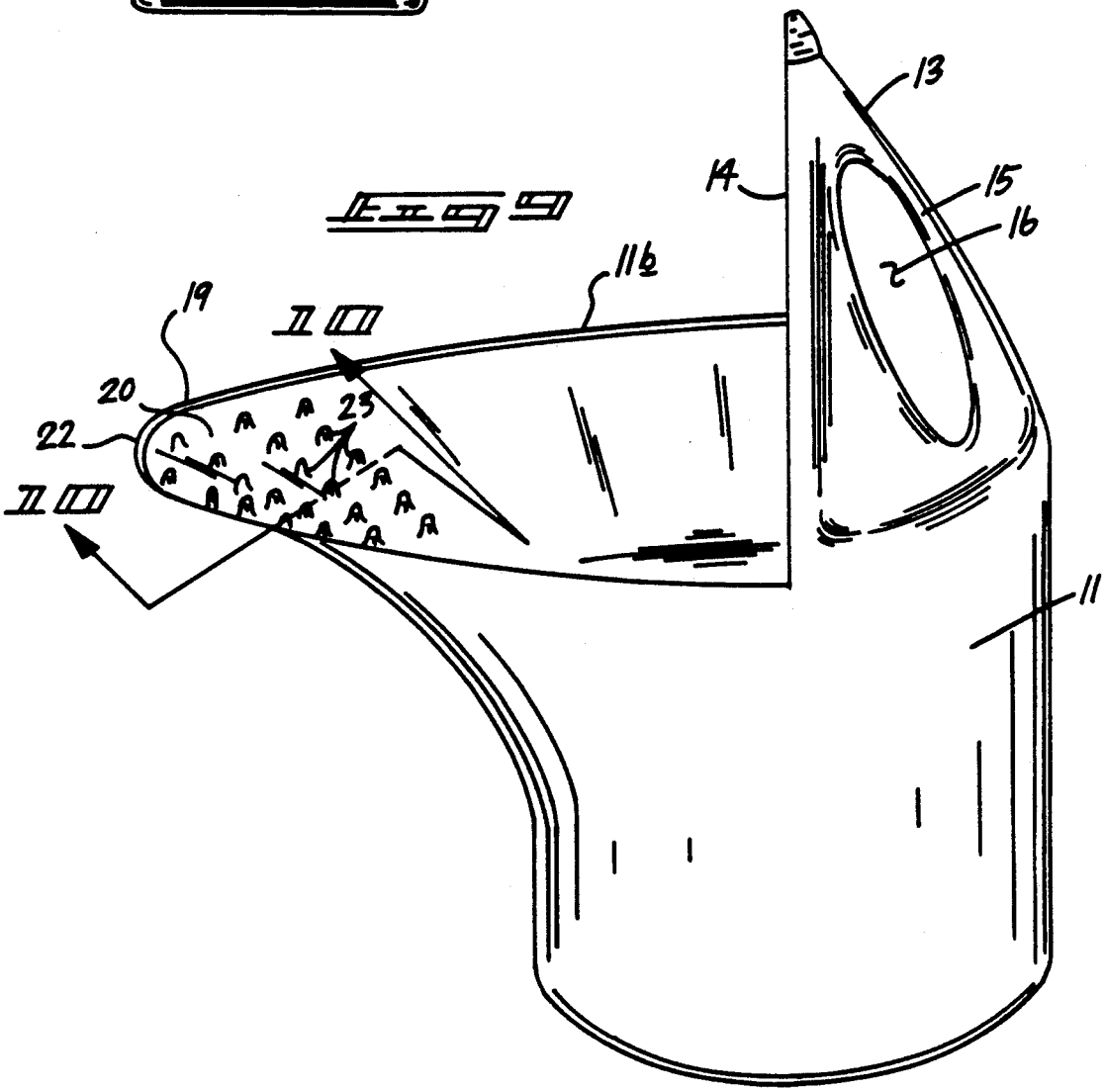
FIG. 9 is an isometric illustration of the further modified construction, as illustrated in FIG. 8.

FIGS. 8 and 9 illustrate an improved spout defined by an elliptical spout projection 19 extending forwardly of the elliptical container upper edge **11*b* of the container 11, wherein the spout 19 includes a spout forward arcuate edge 22. An interior concave surface 20 of the spout 19 includes a matrix of projections 23 directed upwardly therefrom, wherein each of the projections 23 includes an upper tip that is directed upwardly towards the forward arcuate edge 22. In this manner, a paint brush 26 (see FIG. 10 for example) positioned upon the projections 23 prevented from sliding interiorly of the container 11. Further, the forward angulation of the upper tips of the projections 23 minimize fluid obstruction and fluid flow from the spout 19**.

Figure 11:
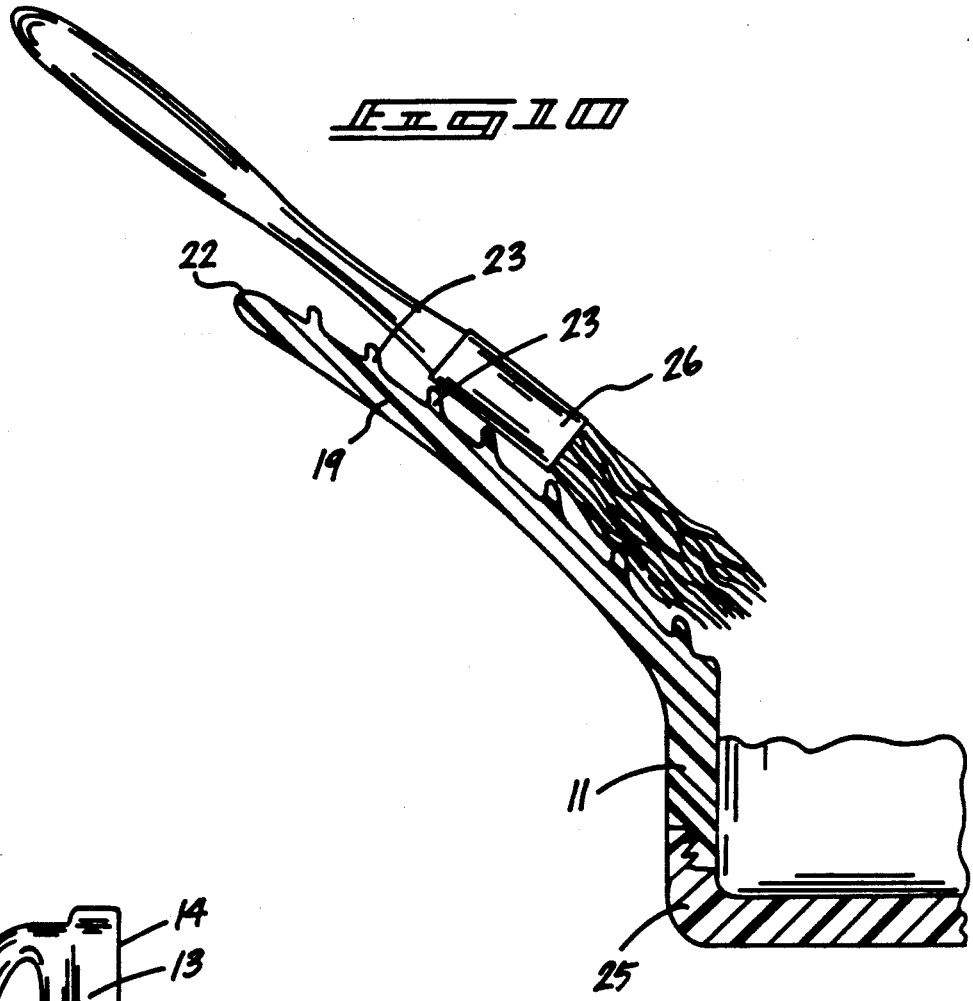
FIG. 11 is an orthographic exploded side view taken in elevation of the removable lower container utilized by the instant invention.
Figure 12:
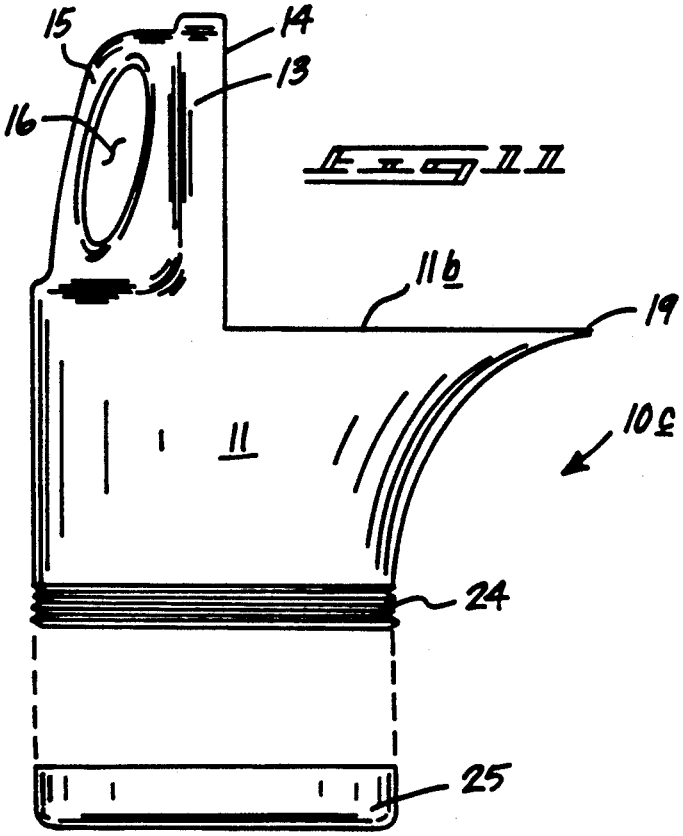

The modified container **10*c*, as illustrated in FIGS. 10 and 11, further includes an internally threaded cup member 25 threadedly mounted to an externally threaded lower end 24 of the container 11. Removal of the cup member 25 permits enhanced ease of cleaning of the bucket construction 10*c***, as illustrated.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A paint bucket construction comprising, a cylindrical container defined about a vertical container axis, the container including an upper container edge, the upper container edge aligned in a single first plane arranged orthogonally relative to the container axis defined by the container, and a support projection integrally mounted to the upper container edge extending over the container and including a support projection forward edge, the support projection forward edge arranged in a second plane arranged orthogonally relative to the first plane, and wherein the second plane includes the container axis, and the support projection including a handle arranged orthogonally relative to the second plane, and wherein the container upper edge includes a pouring spout, the pouring spout aligned with the handle and the pouring spout including a pouring spout upper edge, and wherein the pouring spout upper edge is contained within the first plane, and wherein the pouring spout upper edge is of a generally elliptical configuration, and wherein the pouring spout includes an interior surface directed interiorly of the container, and wherein the upper surface includes a matrix of projections mounted orthogonally thereon for engaging a painting implement positioned on the projections, and wherein each of the projections includes an upper tip, and each upper tip is directed forwardly towards the elliptical pouring spout edge, and wherein the container includes a lowermost end, the lowermost end defined by an externally threaded surface, and further including a cup-shaped bottom end portion, the cup-shaped bottom end portion including an internally threaded surface securable to the externally threaded surface of the container.

* * * * *